United States Patent [19]

Oswald et al.

[11] 4,307,807

[45] Dec. 29, 1981

[54] APPARATUS FOR SORTING CONICAL BOBBIN TUBES OF TEXTILE MACHINES

[75] Inventors: Peter Oswald, Matzingen; Daniel R. Rietschin, Winterthur, both of Switzerland

[73] Assignee: Rieter Machine Works, Ltd., Winterthur, Switzerland

[21] Appl. No.: 192,503

[22] PCT Filed: May 23, 1979

[86] PCT No.: PCT/EP79/00038

§ 371 Date: Feb. 6, 1980

§ 102(e) Date: Jan. 28, 1980

[87] PCT Pub. No.: WO80/00020

PCT Pub. Date: Jan. 10, 1980

[30] Foreign Application Priority Data

Jun. 6, 1978 [CH] Switzerland ..... 6170/78

[51] Int. Cl.[3] ..... B07C 9/00

[52] U.S. Cl. ..... 209/540; 209/604; 209/927; 57/270; 57/274

[58] Field of Search ..... 209/539, 540, 544, 601, 209/600, 604, 927; 57/270, 274; 33/178 E

[56] References Cited

U.S. PATENT DOCUMENTS

| | | | |
|---|---|---|---|
| 2,459,309 | 1/1949 | Cotchett | 209/539 |
| 2,615,566 | 10/1952 | Ball et al. | 209/539 |
| 3,049,231 | 8/1962 | Craudall et al. | 209/600 X |
| 3,107,788 | 10/1963 | Thiele et al. | 209/604 X |
| 3,387,703 | 6/1968 | Foster | 209/604 |
| 3,905,184 | 9/1975 | Takai et al. | 57/274 |

*Primary Examiner*—Joseph J. Rolla

*Attorney, Agent, or Firm*—Werner W. Kleeman

[57] ABSTRACT

An apparatus for sorting conical bobbin tubes for textile machines with their tip ends located to one side comprises a supply device supplying individual bobbin tubes transversely of their axes along a guide table and between two lateral guide edges. The distance of the lateral guide edges from the guide table is equal to the mean bobbin tube diameter and the mutual distance between which diminishes, seen in the direction of the bobbin tube supply, from a value greater than the bobbin tube length to a value smaller than the bobbin tube length. During their movement in the supply direction the bobbin tubes are forced to move longitudinally in the direction of their tip end, which permits sorting them with their tip end to one side. For also automatically sorting bobbin tubes of varying diameter with their tip end to one side, the guide edges are connected with a feeler, designed as a rod, which checks the mean bobbin tube diameter, in such a manner that their distance from the guide table always corresponds to the mean bobbin tube diameter.

10 Claims, 6 Drawing Figures

Fig. 3
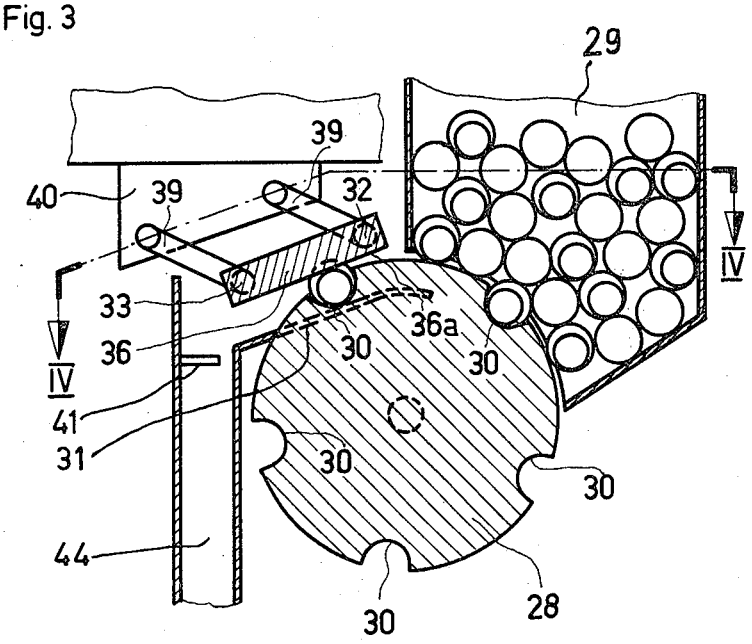
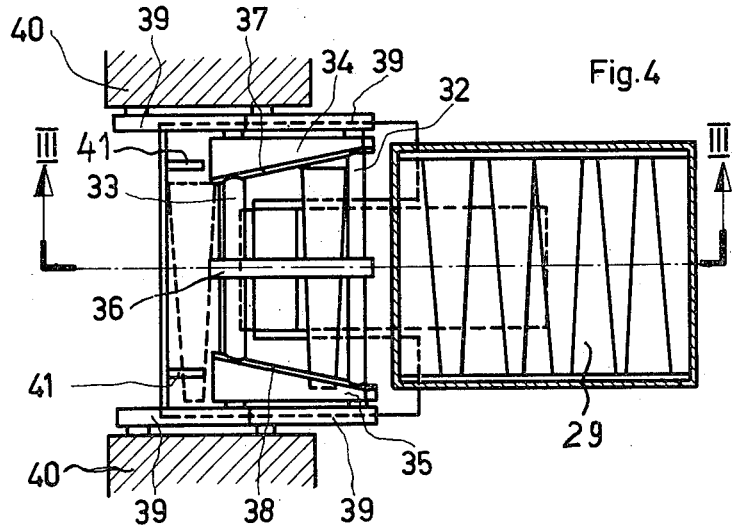
Fig. 4

APPARATUS FOR SORTING CONICAL BOBBIN TUBES OF TEXTILE MACHINES

BACKGROUND OF THE INVENTION

The present invention concerns an apparatus for sorting to the same side the ends of conical bobbin tubes for textile machines, in particular but not exclusively for spinning or twisting machines, by supplying the individual bobbin tubes transverse to their axes along a support means between two lateral guides. The distance of the guides from the support means is substantially equal to the mean bobbin tube diameter, and the mutual distance between such guides, seen in the direction of the bobbin tube supply, diminishes from a value exceeding the bobbin tube length to a value smaller than the bobbin tube length. In this specification the term "mean bobbin tube diameter" refers to the external diameter of an individual bobbin tube at a location approximately midway between two ends. The term is not limited to the diameter of the bobbin tube at the exact mid-length thereof. An apparatus as defined above will be referred to hereinafter as "an apparatus of the type described".

In an apparatus of this type the bobbin tube during its movement in the supply direction is forced by the guide contacting the bobbin tube foot (the end of larger diameter) to move in the direction of the bobbin tube tip (the end of smaller diameter), owing to which movement the bobbin tube may be presented in front of the opening of a chute in such manner, that owing to its weight distribution, it falls with its foot end first, and thus the bobbin tubes are sorted with the same ends to the same side, i.e. in this case, feet downwards.

Devices of such type are applied in the textile industry at all places where conical bobbin tubes are mechanically handled for their further processing, i.e. where the bobbin tubes are to be presented parallel and oriented with their foot ends, or tip ends respectively, to the same side. This is e.g. the case in the automatically functioning bobbin tube donning device on a ring spinning or ring twisting machine, on which empty bobbin tubes are to be donned to the spindles arranged along one or more rows.

The term "sorting of bobbin tubes" in the context of the present invention is understood in the broadest sense of establishing a geometric arrangement of the conical bobbin tubes depending on their dimensions; their material, weight, color, etc. not being considered. Sorting of bobbin tubes with the same ends to the same side is referred to hereinafter as "orienting" of bobbin tubes.

In a known bobbin tube orienting device of the type described (German DE-AS 2,003,594) two lateral guide edges are arranged in a plane substantially parallel to a guide table in such manner that their distance from the guide table is invariable and substantially equal to the mean diameter of the bobbin tubes to be sorted. This arrangement permits correct orienting of bobbin tubes of identical dimensions, i.e. of bobbin tubes, the largest diameter of which is larger, and the smallest diameter of which is smaller than the fixed distance between the guide edges and the guide table. It presents, however, the disadvantage, that it does not permit automatic orienting of tubes of different diameter, e.g. of bobbin tubes of the same inside diameter but of different thickness. Such bobbin tubes, which can be donned on the spindles without difficulties, cannot be oriented or jam in the machine. This results in a disturbance of the sorting process. This disadvantage is of great practical importance, as in normal spinning mill practice different bobbin tubes are used according to the respective applications on the same machine; these may vary from doffing cycle to doffing cycle. In particular, alternating use of thin walled disposable bobbin tubes and of thick-walled card board or plastic bobbin tubes occurs frequently.

SUMMARY OF THE INVENTION

It thus is an object of the present invention to eliminate the disadvantages of the known sorting device, and to create an apparatus of the type described for orienting conical or tapered bobbin tubes, by means of which conical bobbin tubes of differing outside diameters can be oriented, preferably without any setting operation. Additionally the apparatus may be able to eliminate bobbin tubes the outside diameter of which exceeds certain tolerance limits, i.e. to take such bobbin tubes out of the population or family of bobbin tubes presented.

This object is achieved according to the invention by an apparatus of the type described in which both guides are rigidly connected into a unit with a feeler gauging the mean bobbin tube diameter, the gauging movements of which they follow.

As both guides are rigidly connected with the feeler, the distance between the guides and the support means is automatically adapted to the bobbin tube diameter, or more precisely, to the mean bobbin tube diameter, in such manner that in principle any conical bobbin tube is oriented.

If it is desired, however, to orient only bobbin tubes the outside diameter of which is within certain tolerance limits, in accordance with a preferred design example of the apparatus the feeler can be equipped with a control device for checking maintenance of the tolerance limits mentioned, in which arrangement the supply of bobbin tubes can be stopped, or a defective bobbin tube can be eliminated from further processing, if a bobbin tube exceeds the tolerance limits.

BRIEF DESCRIPTION OF THE DRAWINGS

The present invention is described in more detail with reference to illustrated design examples. There is shown in.

DETAILED DESCRIPTION OF PREFERRED EMBODIMENTS

Figure 1:
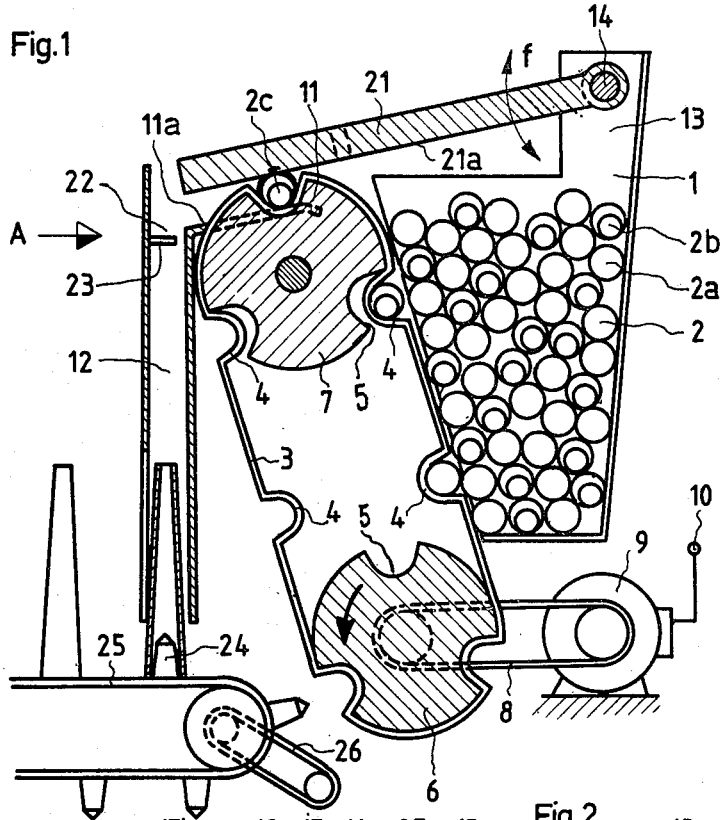
FIG. 1: a side view of the inventive apparatus shown schematically in a section along line I—I of FIG. 2 as applied on a doffing machine of a ring spinning machine.

In FIG. 1 a receiver 1 for the conical bobbin tubes 2, 2*a*, 2*b*, etc. contains the bobbin tubes in a parallel arrangement, in which, however, the tip ends, and the foot ends, respectively, are not all directed to the same side, but are disposed at random, which arrangement is sometimes called "not tip-oriented", or also random arrangement. With respect to the present embodiments it is only required that the bobbin tubes can be supplied "individually" in a direction transverse to their axes along a guide table, which provides a support means for the bobbin tubes. In this context the term "individual" is understood to signify supply of the bobbin tubes with a certain mutual distance between them being maintained.

For this purpose a pocket transporting device known as such is used, comprising a transporting belt 3 with transport pockets 4 provided at regular intervals. The belt extends between two rolls 6 and 7 provided with recesses 5 corresponding to the pockets 4. The lower roll 6 is driven in a continuous counter clockwise rotation, e.g. using a drive belt 8 with a motor 9, the current supply connection for the motor 9 being designated with 10.

The transporting belt 3 elevates within its pockets 4 bobbin tubes 2 to the point where they are deposited onto a guide table 11 arranged to both sides of the roll 7 (FIG. 2), a recess for the roll 7 being provided at the centre of the guide table 11. As the roll 7 rotates, the bobbin tube **2*c* placed in a pocket 4 is pushed transverse to its longitudinal axis towards the left hand side onto the table 11 and gradually is shifted out of the pocket until at the front portion 11*a* of the guide table it leaves the pocket 4 entirely. As the guide table 11, in the direction of movement of the bobbin tube, is slightly inclined downward, and owing to the inertia of the bobbin tube 2*c* itself, the bobbin tube 2*c* slides further along the guide table 11 over a further, small portion of the guide table 11 into the zone of a drop chute 12**, in which it can fall down freely as explained later.

During the movement of the bobbin tube **2*c* along the guide table 11 the bobbin orienting process is started. For this purpose in the design example according to FIGS. 1 and 2 a cross-shaft 14 is pivotably supported on two vertical extensions 13 of the receiver 1. Outside of the receiver 1 the cross-shaft 14 supports arms 15 and 16, each rigidly mounted on it. At the end of each arm is a guide body 19 and 20 respectively, which comprises a lateral guide edge 17 and 18 respectively. The lateral guide edges 17 and 18 are arranged in a common plane substantially parallel to the guide table 11, and their mutual distance diminishes, as seen in the direction of the bobbin tube supply, from the entry side, i.e. from the distance between the points 17*a* and 18*a* which is greater than the bobbin tube length, to a distance at the end, between the points 17*b* and 18*b*, which is smaller than the bobbin tube length. The lateral guide edges 17 and 18 thus form a track which converges in the direction of the bobbin tube supply. Furthermore a rod 21 is provided, also mounted rigidly on the cross-shaft 14, midway between the two arms 15 and 16, the lower edge 21*a* of which rod 21 is arranged in the same plane as the guide edges 17 and 18, and which functions as a feeler gauging the bobbin tube 2*c* along its mean diameter. The system comprising the cross-shaft 14, the arms 15 and 16 and the rods 21 forms a unit which is pivotable about the supports of the cross-shaft 14, as indicated in FIG. 1** by an arrow f.

Figure 2:
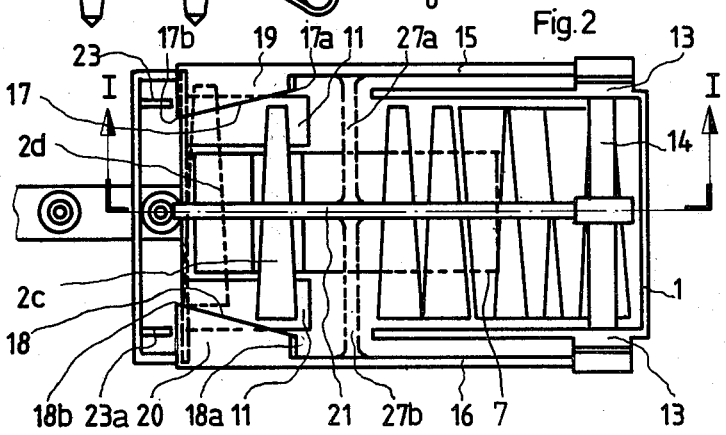
FIG. 2: a top view of the apparatus according to FIG. 1, FIG. 3: another design example of the inventive apparatus, shown in a section along the line III—III of FIG. 4, FIG. 4: a top view of the apparatus according to FIG. 3 in a section along the line IV—IV of FIG. 3, FIG. 5: a schematic, enlarged view of the apparatus according to FIGS. 3 and 4, FIG. 6: a detail of the inventive apparatus combined with a tube elimination device.

The rod 21 with its lower edge **21*a* directly contacts the bobbin tube 2*c*, owing to its location, in the middle zone of the bobbin tube 2*c*, and thus its distance from the guide table 11 corresponds to the mean diameter of the bobbin tube. Also the guide edges 17 and 18, which are arranged in the same plane as the edge 21*a* thus also are located at a distance from the guide table 11 which corresponds to the mean bobbin tube diameter, in such manner that the edge 17 or 18 respectively, adjacent the bobbin tube foot, necessarily comes into contact with the tube foot, whereas the tip of the bobbin tube can slide down unimpeded between the guide table and the other guide edge. The bobbin tube thus is forced to effect a longitudinal movement in the direction of the bobbin tube tip by one of the guide edges 17 or 18 respectively, along which its foot slides. Such movement is referred to hereinafter as "longitudinal" movement of the bobbin tube. In FIG. 2 the position of the bobbin tube 2*d* is indicated with broken lines, shortly before it drops into the chute 12. Owing to the movable arrangement of the guide edges 17 and 18 and of the rod 21, it is not required that the inclination of the guide table 11 corresponds to the inclination of the rod 21 itself: thus also a curved guide table (not shown) could be employed instead of a straight one. The rod 21 always is supported on the middle zone of the bobbin tube 2*c* and ensures that the distance of the guide edges 17 and 18 from the guide table always corresponds to the mean diameter of the bobbin tube. It is of importance, that the rod 21 and thus the guide edges 17 and 18 can adapt their positions automatically to any mean bobbin tube diameter by pivoting about the cross-shaft 14**, in such manner that using the same sorting apparatus conical bobbin tubes with identical diameters or with varying diameters, and in particular any type of bobbin tube from thin paper bobbin tubes to the thicker cardboard or plastic bobbin tubes, can be processed without difficulties correctly and without any setting operations, i.e. the operator is not required to reset the machine because of a change of bobbin type.

The bobbin tube **2*c* arriving at the front portion 11*a* of the table 11 shifted in longitudinal direction then is dropped in practically horizontal position into the opening 22 of the drop chute 12, in which in known manner two directing pins 23 and 23*a* are provided extending across the chute. One of the pins always is located in the zone of the top of the longitudinally shifted bobbin tube, in such manner that the bobbin tube tip is supported by the pin 23 or by the pin 23*a***, while the bobbin tube foot falls freely without delay. During the dropping movement the bobbin tube thus always is turned such that its foot end necessarily falls first, and the bobbin tubes thus are sorted with their tip ends, or foot ends respectively, to the same side, i.e. feet downwards in this example.

If the apparatus according to FIGS. 1 and 2 is applied in a bobbin tube doffing and donning machine, the bobbin tube dropping vertically from the chute 12 is placed onto the pin 24 of a bobbin tube transporting belt 25. The transporting belt 25 moves continuously or stepwise, driven e.g. by a belt drive 26, in such manner that successively all pins of the transporting belt 25 are supplied with vertical bobbin tubes. The drive 9 of the transporting belt 3 and drive belt 26 of the transporting belt 25 are coordinated by suitable means, not shown, in such manner, that if a bobbin tube is supplied into the chute 12 always an empty pin 24 is ready below the chute. Such bobbin tube doffing and donning devices integrated into the ring spinning machine are known in practical spinning mill use, and thus a further description can be dispensed with in this context.

The rod 21 extends in the direction of the bobbin tube supply advantageously to about the downstream ends of the guide edges 17 and 18.

The solution, shown in FIGS. 1 and 2, with the two arms 15 and 16 and the rod 21, which are rigidly connected with the cross-shaft 14 as a unit, does not represent the only arrangement of an apparatus of this type: thus, e.g. the rod 21, for increasing the stability of the apparatus, can be connected with the arms 15 and 16 by two cross-members 27*a* and 27*b* (indicated with broken lines in FIG. 2), or the support of the rod 21 on the cross-shaft 14 can be dispensed with, and the rod 21 can be joined with the two arms 15 and 16 into a rigid unit via the two cross members 27*a* and 27*b*. Also it can be imagined, that only the rod 21 is pivotably supported on the cross-shaft 14, whereas the two arms 15 and 16 via the cross-members 27*a* and 27*b* are rigidly connected with the feeler or rod 21.

In FIGS. 3 and 4 an alternative design example is shown of the inventive apparatus, which differs from the one shown in FIGS. 1 and 2 in that, instead of the transporting belt, as the means for supplying individual bobbin tubes, a transporting drum 28 is provided in this arrangement and in that another suspension of the system comprising the guide bodies and the feeler is chosen.

The receiver 29 in this arrangement is adapted to the transporting drum 28 and contains bobbin tubes arranged in the same manner as the receiver 1 in FIGS. 1 and 2.

Also in the transporting drum 28 transporting pockets 30 are provided, by means of which individual bobbin tubes are supplied to the guide table 31, which is of the same form as the table 11 in FIGS. 1 and 2. Above the guide table 31 via two shafts 32 and 33 two guide bodies 34 and 35 and a rod 36 arranged midway between the guide bodies 34 and 35, which rod functions as the bobbin tube feeler, are interconnected into a unit. Also in this arrangement the guide edges 37 and 38 of the guide bodies 34 and 35 are arranged in the same plane as the lower edge 36*a* of the rod 36 and are arranged with respect to each other in the same manner as the guide edges 17 and 18 described with reference to FIGS. 1 and 2. They also cause the longitudinal movement of the bobbin tubes on the guide table 31. Each shaft 32 and 33 is suspended on two lever arms 39 of the same length each from a fixed point of the machine frame 40 in such manner that a parallel guiding arrangement for the guide bodies 34 and 35 and the rod 36 is established.

The other elements of the apparatus shown in FIGS. 3 and 4 correspond in their functions and structures to the ones described with reference to FIGS. 1 and 2, in such manner that their further description can be dispensed with. In FIG. 4 a bobbin tube already shifted across and longitudinally to a position above the opening of the drop chute is indicated with broken lines. Its tip is located above a directing pin 41 which causes turning of the bobbin tube.

The apparatus according to FIGS. 3 and 4 possesses the advantage that the guide edges 37 and 38 and the rod 36, which are movable parallel to the guide table and which are arranged at a certain mutual distance corresponding to a bobbin tube, remain parallel to the table, whereas in the pivoting arrangement according to FIGS. 1 and 2 the guide edges 17 and 18 and the rod 21 can form a variable acute angle with respect to the guide table 11 depending on the bobbin tube diameter. Consequently, the rod 36 remains still as bobbin tube of any given diameter pass through, or at least maintains the same disposition relative to the machine frame, which is not the case in the design example shown in FIGS. 1 and 2. This characteristic renders the apparatus particularly suitable for the application of a control device for checking the bobbin tube diameter, as the movements of the rod 36 are a function merely of the bobbin tube diameter (but not also of the geometric arrangement of the pivoting point, as in the arrangement shown in FIGS. 1 and 2).

Figure 5:
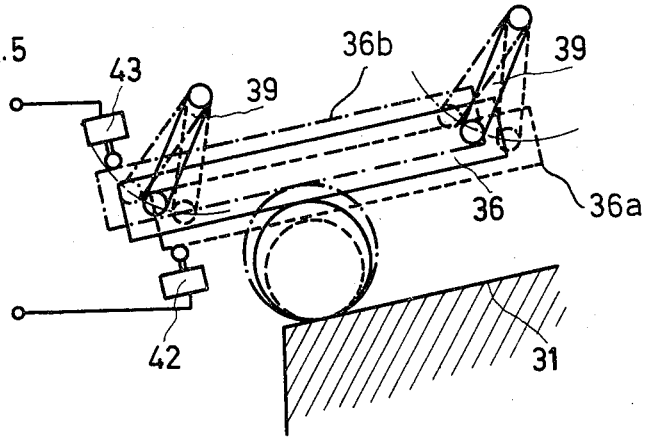

In FIG. 5 the possibility of mounting a control device for checking the bobbin tube diameter is shown. A control device of this type, as shown in FIG. 5, comprises e.g. two limit switches 42 and 43, which are mounted rigidly on stationary machine frame parts not shown, and which are activated directly (i.e. by contact with the rod 36 itself) or indirectly (i.e. by contact with an element not shown kinematically connected rigidly with the rod 36) in the lowest, and in the highest position respectively of the rod 36. The lowest position of the rod 36 in this arrangement corresponds to the minimum mean bobbin tube diameter permissible (indicated with broken lines) and the highest position corresponds to the maximum bobbin tube diameter still permissible (indicated with dash-dotted-lines). If the mean bobbin tube diameter ranges between the limits indicated in FIG. 5 with broken or dash-dotted lines, corresponding with the lowest and the highest positions, 36*a* and 36*b* respectively of the rod 36, neither limit switch 42 or 43 is activated and the bobbin is processed further in normal manner, i.e. is dropped into the chute 44 (FIG. 3) or into the chute 12 (FIG. 1). If, however, either of the limit switches 42 or 43 is activated, a control function is activated, which e.g. causes the supply of bobbin tubes to be stopped by stopping the rotation of the transporting drum 28, and/or causes the sorting out of the defective bobbin tube, as shown e.g. in FIG. 6

Instead of the limit switches 42 and 43 also other electrical or mechanical elements fulfilling the same function can be applied.

Figure 6:
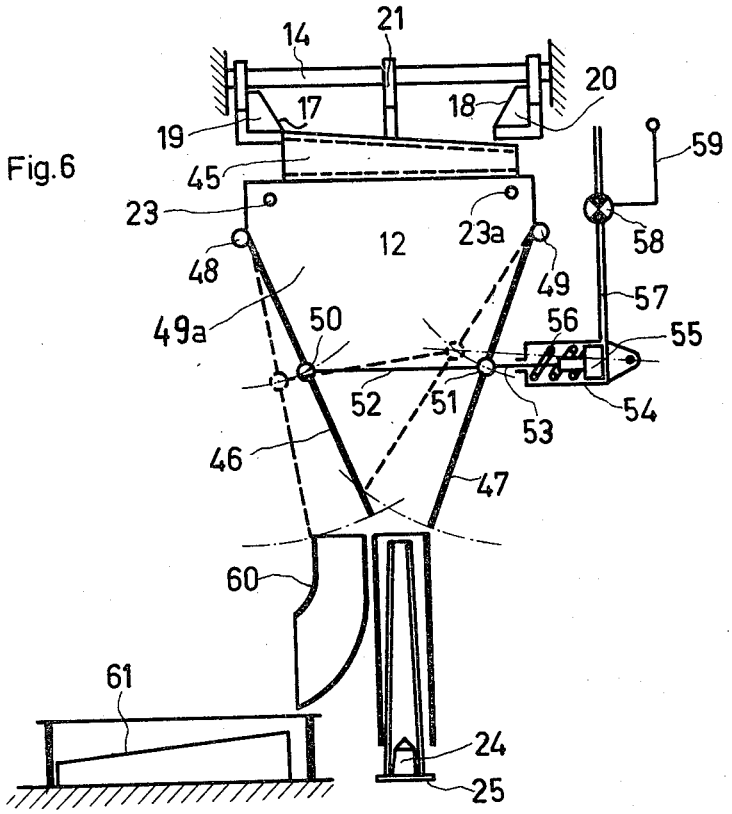

In FIG. 6 a suitable bobbin tube eliminating device is shown schematically, which cooperates with the control device according to FIG. 5 and which can be applied in combination with an apparatus such as the one shown in FIGS. 1 and 2. The elements shown in FIG. 6 which correspond to the ones shown in FIGS. 1 and 2 are designated with the same reference numbers. The device is shown as seen in the direction of arrow A of FIG. 1. In FIG. 6 the drop chute 12 is shown with the directing pins 23 and 23*a*. A bobbin tube 45 has reached the end of the guide edges 17 and 18 and is ready to drop into the chute 12: by means of the guide edge 17 it has been shifted to the right hand side in such manner that later it will drop onto the right hand side directing pin 23*a*.

The drop chute 12 comprises two side walls 46 and 47, which form the chute as a funnel, which walls 46 and 47 are linked at two pivoting points 48 and 49 of the back wall 49*a*. The walls 46 and 47 furthermore are mutually connected at two linking points 50 and 51 via a connecting rod 52, and the linking point 51 furthermore is linked to the piston rod 53 of a pneumatic cylinder 54 with a piston 55 and with a resetting spring 56. Via a duct 57 provide with an electromagnetic valve 58 compressed air can be supplied to the cylinder 54, whereupon the piston 55 moves, overcoming the force of the resetting spring 56, to the left hand side. The electromagnetic valve 58 is controlled via an electric-circuit 59, which is functionally connected with the limit switches 42 and 43 (FIG. 5), in such manner, that if one of the switches is activated, a current flows in the circuit 59 and activates the valve 58. In this manner the walls 46 and 47 are moved from their normal position indicated with solid lines, in which position normal bobbin tubes dropping into the chute 12 are donned onto the pins 24 of the bobbin tube transporting belt 25, into the position indicated with broken lines, in which position "off-size" bobbin tubes are dropped into a side duct 60 with a receiver 61.

The solution shown in FIG. 6 for a bobbin tube eliminating device for "off-size" bobbin tubes represents just one of a great number of possible and imaginable devices of this type, with which the sorting apparatus according to the invention can be combined.

The advantages of the apparatus for orienting bobbin tubes can be summarized as follows:

(a) automatic adaption of the sorting apparatus to the variations in the outside diameter of bobbin tubes. Thus, using the same apparatus, without any manual adjustment of the apparatus, varying bobbin tube types can be oriented, which facilitates the work of the operating personnel.

(b) If a control device is mounted and, if required, a bobbin tube eliminating device, the bobbin tubes are not only oriented but also can be checked and sorted out according to their outside diameter. This ensures that only bobbin tubes fulfilling certain requirements concerning their outside diameter are delivered oriented in the required fashion.

(c) The apparatus is of simple design and is economically feasible, as well as labour-saving and reliable in its function.

It will be apparent that gauging means represented in the drawings by the feeler in the form of the rod 21 in FIG. 1 and the rod 36 in FIG. 3 does not necessarily contact the bobbin tubes at their exact mid-lengths in these embodiments, but will initially contact each tube within a narrow zone extending to either side of its mid-length. The contact point will in any event change slightly as the bobbin tube is moved longitudinally by the guides represented by the guide edges 17*a*, 18*a*. Such variation in the exact contact point is within the use of the term "mean bobbin tube diameter" above.

In addition the feeler could be modified to comprise a pair of bobbin contact elements e.g. rails extending generally along the path of movement of the bobbin tubes over the support means represented by the guide table 11. The elements could be adapted to contact the bobbin tubes between their mid-lengths and their foot ends, one element contacting a bobbin tube oriented in one direction and the other element contacting a bobbin tube oriented in the opposite direction. The elements could be connected together and to the guides to operate the latter in the same way as they are operated by the rods 21 and 36.

While there are shown and described present preferred embodiments of the invention, it is to be distinctly understood that the invention is not limited thereto, but may be otherwise variously embodied and practiced within the scope of the following claims. Accordingly,

We claim:

1. An apparatus for orienting conical or tapered bobbin tubes for textile machines, comprising:

support means along which there are supplied individual bobbin tubes in a direction essentially transversely with respect to their longitudinal axes;

two lateral guides cooperating with said support means and between which there are supplied the individual bobbin tubes;

said two lateral guides being spaced at a distance from the support means which substantially corresponds to the mean bobbin tube diameter;

said two lateral guides being spaced from one another at a mutual distance which, viewed in the direction of supply of the bobbin tubes, diminishes from a value exceeding the bobbin tube length to a value smaller than the bobbin tube length;

a feeler for gauging the mean bobbin tube diameter;

both of said lateral guides being rigidly connected together with said feeler into a unit; and said two lateral guides following the gauging movements of the feeler.

2. The apparatus as defined in claim 1, further including:

shaft means at which there is pivotably arranged said unit.

3. The apparatus as defined in claim 1, further including:

a machine frame having parallel guides; and said unit being connected to said machine frame containing said parallel guides for enabling parallel pivoting movement.

4. The apparatus as defined in claim 1, further including:

means for automatically donning the bobbin tubes onto spindles of a ring spinning machine using a bobbin doffing and donning device.

5. The apparatus as defined in claim 1, wherein:

said lateral guides comprise guide edges located in a plane; and said feeler comprising a rod arranged symmetrically between said guide edges and said plane containing said guide edges.

6. The apparatus as defined in claim 5, wherein:

the length of said rod, viewed in the direction of supply of the bobbin tubes, substantially corresponds to the length of said guide edges.

7. The apparatus as defined in claim 1, further including:

a control device provided for said feeler and serving for checking the maintenance of tolerance limits of the bobbin tube diameter.

8. The apparatus as defined in claim 7, further including:

means responsive to said control device such that if the tolerance limits are exceeded by a bobbin tube there is interrupted the supply of bobbin tubes.

9. The apparatus as defined in claim 7, further including:

a bobbin tube-eliminating device for removing a bobbin tube exceeding the tolerance limits and for eliminating such removed bobbin tube from further processing.

10. An apparatus for orienting conical or tapered bobbin tubes for textile machines, comprising:

means for supplying individual bobbin tubes in a direction substantially transverse to their lengthwise axes;

support means for supporting the tubes during movement in said direction;

lateral guides between which said bobbin tubes move while supported by said support means;

said lateral guides converging in said direction;

gauging means adapted to gauge an external diameter of an individual bobbin tube located on said support means; and means for enabling adjustment of said lateral guides relative to said support means in dependence upon a bobbin tube diameter gauged by said gauging means, so that one of said lateral guides will engage a foot of an individual bobbin tube while the other lateral guide will permit a tip of the bobbin tube to pass between itself and said support means.

* * * * *